US011577881B2

(12) United States Patent
Renkert et al.

(10) Patent No.: US 11,577,881 B2
(45) Date of Patent: Feb. 14, 2023

(54) ADHESIVE TAPE DISPENSER WITH EXTERNAL CORNER TAPE ALIGNMENT MECHANISM

(71) Applicant: BLUTAPER, LLC, Port Orchard, WA (US)

(72) Inventors: Michael F. Renkert, Port Orchard, WA (US); Kevin G. Shumway, Port Orchard, WA (US)

(73) Assignee: BLUTAPER, LLC, Port Orchard, WA (US)

( * ) Notice: Subject to any disclaimer, the term of this patent is extended or adjusted under 35 U.S.C. 154(b) by 0 days.

(21) Appl. No.: 17/499,662

(22) Filed: Oct. 12, 2021

(65) Prior Publication Data

US 2022/0111997 A1 Apr. 14, 2022

Related U.S. Application Data

(63) Continuation of application No. 16/168,604, filed on Oct. 23, 2018, now Pat. No. 11,142,366.

(51) Int. Cl.

| | |
|---|---|
| ***B65D 5/70*** | (2006.01) |
| ***B65H 35/00*** | (2006.01) |
| *B65D 5/74* | (2006.01) |

(52) U.S. Cl.

CPC ..... *B65D 5/708* (2013.01); *B65H 35/0033* (2013.01); *B65D 5/74* (2013.01); *B65H 35/004* (2013.01); *B65H 35/0026* (2013.01)

(58) Field of Classification Search

CPC ..... B65D 5/708; B65D 5/74; B65H 35/0033; B65H 35/0026; B65H 35/004

See application file for complete search history.

(56) References Cited

U.S. PATENT DOCUMENTS

| | | | | |
|---|---|---|---|---|
| 2,473,072 | A * | 6/1949 | Plouff | B65H 49/205 83/610 |
| 2,817,404 | A * | 12/1957 | Vogt | B65H 35/0026 225/73 |
| 3,125,263 | A * | 3/1964 | Harbour | B65H 35/0033 156/577 |
| 7,441,581 | B2 | 10/2008 | Pitzen | |
| 8,820,382 | B1 | 9/2014 | Renkert | |
| 2012/0061026 | A1 | 3/2012 | Lu | |
| 2015/0266692 | A1 | 9/2015 | Tiedemann et al. | |

* cited by examiner

*Primary Examiner* — Omar Flores Sanchez

(74) *Attorney, Agent, or Firm* — Galvin Patent Law LLC; Brian R. Galvin

(57) ABSTRACT

An adhesive tape dispensing device with a tape alignment mechanism, comprising a body formed from a rigid material or materials, configured to hold and dispense adhesive tape, and a tape alignment mechanism comprising at least one spring that presses laterally against the edge of the tape, the side of the tape form, or against a hub onto which the tape is mounted, and a caulking spacer with guides which allows for dispensing of tape along an external corner, even where such corners are not square.

15 Claims, 18 Drawing Sheets

ADHESIVE TAPE DISPENSER WITH EXTERNAL CORNER TAPE ALIGNMENT MECHANISM

CROSS-REFERENCE TO RELATED APPLICATIONS

Priority is claimed in the application data sheet to the following patents or patent applications, the entire written description of each of which is expressly incorporated herein by reference in its entirety:

Ser. No. 16/168,604

BACKGROUND OF THE INVENTION

Field of the Art

The disclosure relates to the field of adhesive tape dispensers, and more particularly to an adhesive tape dispenser with a tape alignment mechanism.

Discussion of the State of the Art

In the field of painting, precision is a necessity for painters. Trim work in housing and other types of buildings needs to be covered during the process of painting walls, while the corners and edges of walls and ceilings need to be covered when more than one color is used. Crisp lines, colors not running together, precision corner cutting for tape, and paints not being mixed are all part of the precision techniques of painting. Caulking is also a precision skill; areas next to those that are being caulked need to be covered so that they are not accidentally caulked as well.

Painters often use adhesive tape to cover trims, corners, edges, and other parts that need protection from the paint and caulking process. Painters also use adhesive tapes as a form of stenciling when tasked with painting designs and patterns. However, application of long strips of tape with consistent alignment is difficult with existing tape dispensing devices and methods, particularly in corners such as where a floor meets the base of a wall. Existing tape dispensers further do not dispense tape with consistent alignment, and do not account for inconsistencies in manufacturing of rolls of tape, such as when the roll of tape is slightly conical due to mis-rolling or when the cardboard tape form bulges out slightly from the roll of tape. Taping along external (convex) corners is difficult, especially where such corners deviate from the perpendicular.

What is needed, then, is an adhesive tape dispensing device with a tape alignment mechanism that dispenses tape with consistent alignment, especially along external corners, and accounts for external corners that are not square.

SUMMARY OF THE INVENTION

Accordingly, the inventor has conceived and reduced to practice, an adhesive tape dispenser with tape alignment mechanism that dispenses tape with consistent alignment along external corners, even where such corners are not square. The following non-limiting summary of the invention is provided for clarity, and should be construed consistently with embodiments described in the detailed description below.

According to a preferred embodiment, an adhesive tape dispensing device with caulking spacer is disclosed, comprising, a body formed from a rigid material or materials, comprising a cavity with an open face, a tape well within the cavity for holding a roll of adhesive tape, and a plurality of attachment points for a caulking spacer; a tape alignment mechanism comprising at least one spring attached to the body that presses laterally against a first side of the roll of adhesive tape, the first side being the side of the roll of adhesive tape opposite the open face; and a caulking spacer attached to the open face of the body, the caulking spacer comprising a face plate, a plurality of fasteners for attachment of the plate to the body at the attachment points, and a guide attached to the face plate via a flexible linkage; wherein the lateral force of the at least one spring causes the roll of adhesive tape to be pushed toward the face plate of the caulking spacer; and wherein, when in use with the guide pressed against a second surface of an external corner, the adhesive tape may be dispensed onto a first surface of the external corner that is not perpendicular to die second surface.

According to a preferred embodiment, an adhesive tape dispensing device with a tape alignment mechanism is disclosed, comprising a body formed from a rigid material or materials comprising a cavity with an open face, a tape well within the cavity for holding a roll of adhesive tape, and a plurality of attachment points for a caulking spacer; a tape alignment mechanism comprising at least one spring attached to the body that presses laterally against the tape hub on a side proximal to a first side of the roll of adhesive tape, the first side being the side of the roll of adhesive tape opposite the face plate of the caulking spacer; and a caulking spacer attached to the open face of the body, the caulking spacer comprising a face plate, a plurality of fasteners for attachment of the plate to the body at the attachment points, and a guide attached to the face plate via a flexible linkage; wherein the lateral force of the at least one spring causes the tape hub and roll of adhesive tape to be pushed toward the face plate of the caulking spacer, and wherein, when in use with the guide pressed against a second surface of an external corner, the adhesive tape may be dispensed onto a first surface of the external corner that is not perpendicular to the second surface.

According to a preferred embodiment, an adhesive tape dispensing device with a tape alignment mechanism is disclosed, comprising: a body formed from a rigid material or materials comprising a cavity with an open face, a tape well within the cavity for holding a roll of adhesive tape, and a plurality of attachment points for a caulking spacer; a body formed from a rigid material or materials comprising a cavity with an open face, a tape well within the cavity for holding a tape hub onto which may be mounted a roll of adhesive tape, and a plurality of attachment points for a caulking spacer; and a tape alignment mechanism comprising the tape hub which comprises at least one spring attached to the tape hub that presses laterally against the body on a side proximal to a first side of the roll of adhesive tape, the first side being the side of the roll of adhesive tape opposite die face plate of the caulking spacer; the caulking spacer attached to the open face of the body, the caulking spacer comprising a face plate, a plurality of fasteners for attachment of the plate to the body at the attachment points, and a guide attached to the face plate via a flexible linkage; wherein the lateral force of die at least one spring causes the tape hub and roll of adhesive tape to be pushed toward the face plate of die caulking spacer, and wherein, when in use with the guide pressed against a second surface of an external corner, the adhesive tape may be dispensed onto a first surface of the external corner that is not perpendicular to the second surface.

According to an aspect of an embodiment, the at least one spring is a leaf spring. According to an aspect of an embodiment, the at least one leaf spring is molded or formed from the body of the device.

According to an aspect of an embodiment, the at least one leaf spring further comprises a nodular tip.

According to an aspect of an embodiment, the at least one spring is configured to be adjustable to accommodate different widths of adhesive tape.

BRIEF DESCRIPTION OF THE DRAWING FIGURES

The accompanying drawings illustrate several aspects and, together with die description, serve to explain die principles of the invention according to the aspects. It will be appreciated by one skilled in the art that the particular arrangements illustrated in the drawings are merely exemplary, and are not to be considered as limiting of the scope of the invention or the claims herein in any way.

DETAILED DESCRIPTION

Figure 1:
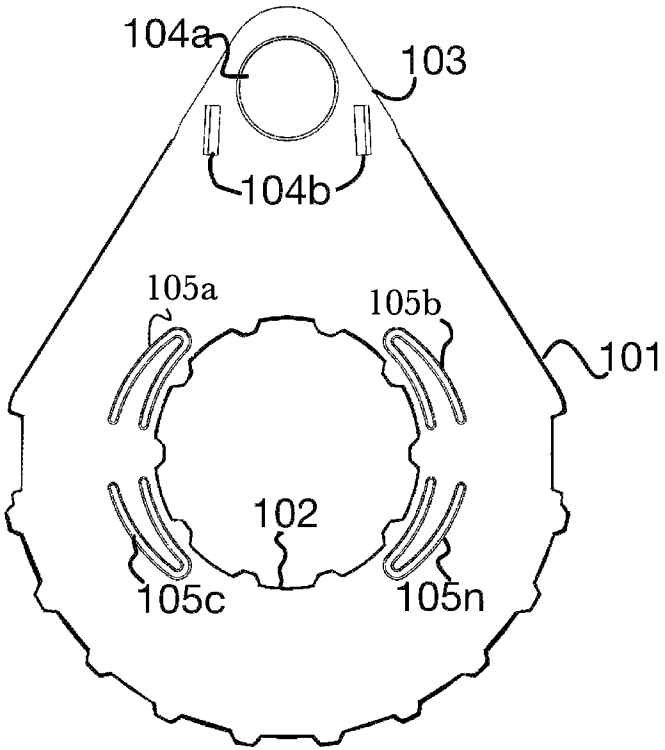
FIG. 1 is an illustration of an exemplary adhesive tape dispenser according to an embodiment, illustrating a top side view of device design.

Accordingly, the inventor has conceived and reduced to practice, an adhesive tape dispenser with tape alignment mechanism that dispenses tape with consistent alignment along external corners, even where such corners are not square.

One or more different aspects may be described in the present application. Further, for one or more of die aspects described herein, numerous alternative arrangements may be described; it should be appreciated that these are presented for illustrative purposes only and are not limiting of the aspects contained herein or the claims presented herein in any way. One or more of the arrangements may be widely applicable to numerous aspects, as may be readily apparent from the disclosure. In general, arrangements are described in sufficient detail to enable those skilled in the art to practice one or more of the aspects, and it should be appreciated that other arrangements may be utilized and that structural, logical, software, electrical and other changes may be made without departing from the scope of the particular aspects. Particular features of one or more of the aspects described herein may be described with reference to one or more particular aspects or figures that form a part of the present disclosure, and in which are shown, by way of illustration, specific arrangements of one or more of the aspects. It should be appreciated, however, that such features are not limited to usage in die one or more particular aspects or figures with reference to which they are described. The present disclosure is neither a literal description of all arrangements of one or more of the aspects nor a listing of features of one or more of the aspects that must be present in all arrangements.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an aspect with several components in communication with each other does not imply that all such components are required. To the contrary, a variety of optional components may be described to illustrate a wide variety of possible aspects and in order to more fully illustrate one or more aspects. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the aspects, and does not imply that die illustrated process is preferred. Also, steps are generally described once per aspect, but this does not mean they must occur once, or that they may only occur once each time a process, method, or algorithm is carried out or executed. Some steps may be omitted in some aspects or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other aspects need not include the device itself.

Techniques and mechanisms described or referenced herein will sometimes be described in singular form for clarity. However, it should be appreciated that particular aspects may include multiple iterations of a technique or multiple instantiations of a mechanism unless rioted otherwise. Process descriptions or blocks in figures should be understood as representing modules, segments, or portions of code which include one or more executable instructions for implementing specific logical functions or steps in the process. Alternate implementations are included within the scope of various aspects in which, for example, functions may be executed out of order from that shown or discussed, including substantially concurrently or in reverse order, depending on the functionality involved, as would be understood by those having ordinary skill in the art.

Definitions

The term "adhesive tape" refers to any one of a variety of combinations of backing materials coated with an adhesive, typically in the form of a ribbon or strip. Different backing materials and adhesives can be used depending on the intended use, and the width of the tape can vary, depending on the application.

The term "roll of tape" or "tape roll" means adhesive tape that has been wound in a continuous manner around a form, such as a cardboard tube, such that the tape forms a continuous spiral around the form.

The term "tape form" means a support structure around which adhesive tape may be wound to create a tape roll. A tape form is most often a section of cardboard tubing the same width as the tape, although the tape form may be made of other materials such as plastic or metal, and is not necessarily circular in shape.

Tre term "tapered" means any object having a first width at a first end that narrows to a smaller second with a second end. Examples of a tapered shapes include, but are not limited to, cones, conical frustums, hyperboloids, paraboloids, and funnels.

The term "spring" as used herein means any spring-like device or material to which force may be applied in one direction, and which tends to resist that force by pushing back against it. In one aspect of an embodiment, a spring may be a wound metal wire, but in other embodiments, a spring may be of different forms and different materials. For example, a spring may be flexible, flat piece of metal (otherwise known as a "leaf" spring), or a tab molded into the body of the device.

It is important to note that tape is often mis-rolled, manufactured with inaccurate widths, etc.

FIG. 1 is an illustration of an exemplary adhesive tape dispenser according to an embodiment of the invention, illustrating a top side view 100 of device design. Adhesive tape dispenser 100 may comprise a generally bisected lachrymiform body 101 with a circular center 102 cut out of the middle of die first width bottom portion of lachrymiform shape 101, for springs to be molded (either directly into underside of lachrymiform shape 101 or attached to—as in not built in directly to dispenser 100—to the underside of lachrymiform shape 101) to gently push tape up against a wall, with which the device may be held up against during use (generally, a bisected lachrymiform shape to be assembled as illustrated; however, it should be appreciated that other final shapes may be used according to a desired arrangement or use case, such as an oblong shape or a rectangular shape, or other arrangement); one must having solid walls 101 formed of a rigid material such as metal or plastic, where one end tapers to a smaller second width 108 with a circular shape 104*a* cut out along with two uniform rectangular shapes 104*b* cut out for puncturing blade to assemble to device; and also having a plurality of uniform shapes cut out 105*a-n* around center 102 for holding adhesive tape core in place while dispenser is in use.

Figure 2:
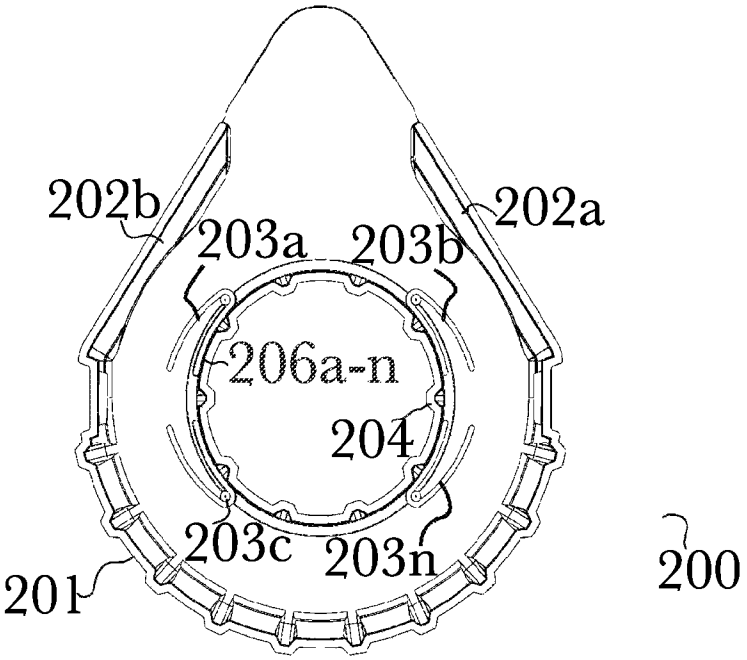
FIG. 2 is an illustration of an exemplary adhesive tape dispenser according to an embodiment, illustrating a bottom side view of device design.

FIG. 2 is an illustration of an exemplary adhesive tape dispenser according to an embodiment, illustrating a bottom side view 200 of device design. According to the embodiment, adhesive tape dispenser 201 has two or more springs 202*a*. 202*b* to apply light pressure to a roll of tape, such that the device may be used up against another surface such as a wall to allow for uniform tape dispensed across a straight surface, the springs 202*a*, 202*b* keeping the tape stable up against a surface, while a cutting knife may cut it when desired 402. Cut-outs 105*a-n* are cut around a plurality of stationary lever arms 20*a-n* that each have a rounded nodule at their tip, for holding core of adhesive tape in place when in use. Circular center 102, 206-*n* has indentations 204 where springs are built-in or affixed, to hold adhesive tape in place.

Figure 3:
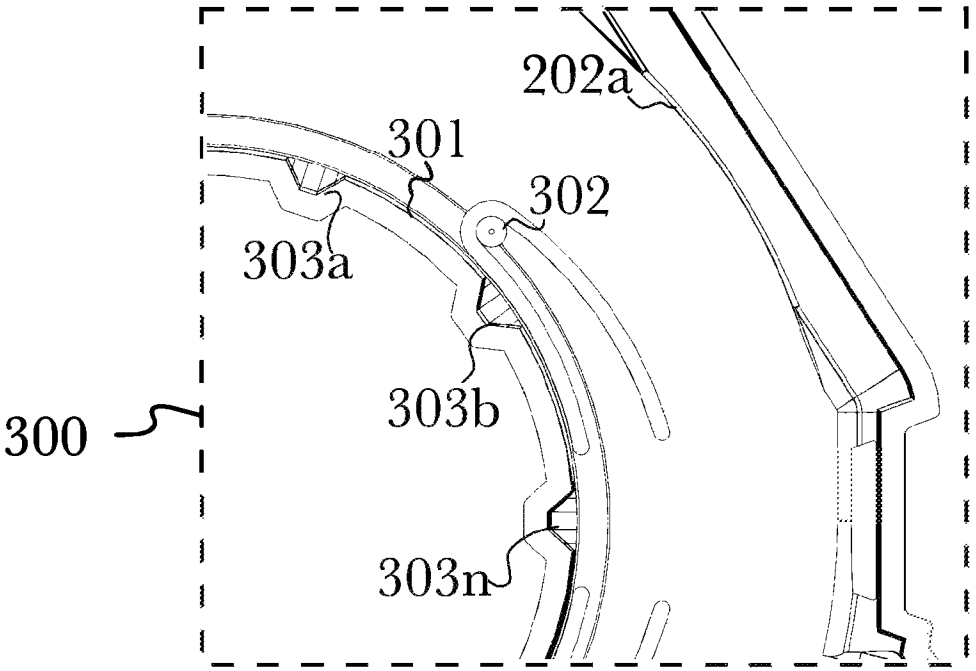
FIG. 3 is an illustration of an exemplary underside close up view of adhesive tape dispenser according to an embodiment, illustrating where springs and strip adhesive assemble to device.

FIG. 3 is an illustration of an exemplary underside close-up view of adhesive tape dispenser according to an embodiment, illustrating where springs and adhesive tape assemble 300 to device 100. Adhesive tape rests between bumper 202*a* and center wall 301, while core of strip adhesive (the object adhesive tape is wound about; core material may be cardboard or plastic) will connect to stationary lever arm nodule tip 302 for added flow consistency of adhesive tape as adhesive is pulled from dispenser 100. Indentations 303*a-n* hold springs (springs used may be, but are not limited to: leaf springs, coiled springs, molded wave springs, or others, and may be permanently affixed to device 100 such as by welding or industrial adhesives, or temporarily affixed to device 100 according to a desired use case) that push against device 100 and a roll of adhesive tape, holding tape roll against wall of device 100 by applying a constant but slight pressure to adhesive tape.

Figure 4:
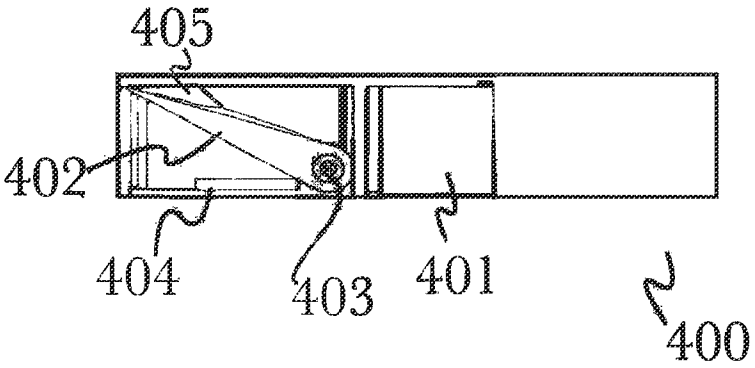
FIG. 4 is an illustration of an exemplary internal side view of adhesive tape dispenser according to an aspect of an embodiment, illustrating within device a blade for cutting adhesive tape.

FIG. 4 is an illustration of an exemplary internal side view of adhesive tape dispenser according to an aspect of an embodiment, illustrating within device 400 a blade for cutting adhesive tape. According to the embodiment, within device 400 above portion of device 401 for holding adhesive tape is blade 402 for severing adhesive tape. Blade 402 is thick at one end with a hollowed-out core for attaching to rotating pin 403. Blade 402 is secured in place partially by rotating pin 403 and by step levels 404; step levels 404 may be comprised of plastic or metal and have two levels (it should be appreciated that device may have more than two levels of step levels such as but not limited to one step, three steps, five steps, etc. according to a desired use case) for blade 402, with help of safety button 405 and rotating pin 403, to move blade 402 along step levels 404 to accommodate different widths of adhesive tapes which can vary. Safety button 405 attaches to device cut-out 104*a* and rests on blade 402. Safety button 405 keeps device users from injury by blocking cut-out 104*a* but also can be pushed down on blade 402 to adjust blade 402 on step level 404 for varying adhesive tape widths.

Figure 5:
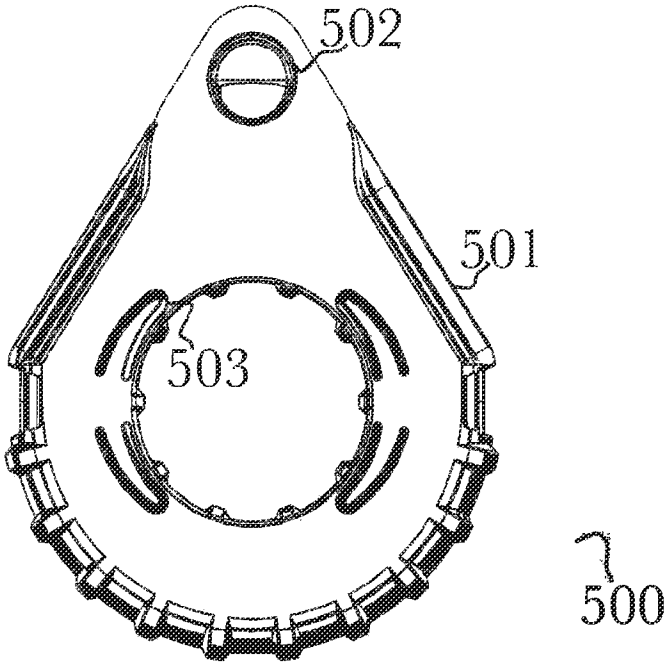
FIG. 5 is an illustration of an exemplary assembled adhesive tape dispenser according to an aspect of an embodiment, illustrating a top side view of device with blade and roll of adhesive tape assembled to device.

FIG. 5 is an illustration of an exemplary assembled adhesive tape dispenser according to an aspect of an embodiment, illustrating a top side view of device with blade and roll of adhesive tape assembled 500 to device. According to the embodiment, assembled device 500 comprises dispenser device 501 with blade assembly 502 attached to cut-outs 104*a*, 104*b* and safety button 405 visible from top view. Adhesive tape 503 can be seen through cut-outs 105*a-n* and attaches to die underside of device 500 by attaching adhesive 503 core to stationary lever arm nodule tips 302, while adhesive 503 rests between device walls 301 and bumpers 202*a*, 202*b*.

Figure 6:
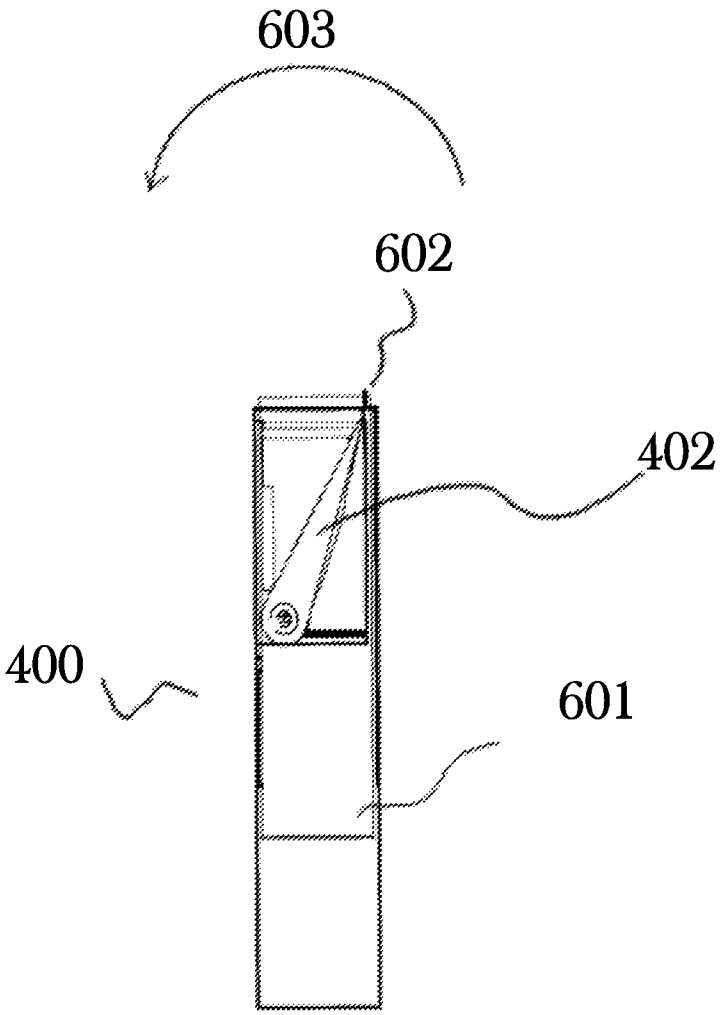
FIG. 6 is an illustration of an exemplary assembled adhesive tape dispenser according to an aspect of an embodiment, illustrating within device blade for cutting, adhesive tape held with tension around device, and motions taken by blade when cutting and dispensing adhesive tape.

FIG. 6 is an illustration of an exemplary assembled adhesive tape dispenser according to an aspect of an embodiment, illustrating within device 400; blade 402 for cutting, adhesive tape held with tension around device 601, and motions 608 taken by blade 402 when cutting and dispensing adhesive tape 601. Adhesive tapes, whose characteristics may vary greatly across different implementations of the instant invention, are held with tension on the end of the invention 601, allowing blade 402 to puncture 602 adhesive tape 601, allowing motion 603 to carry blade 402 across at least 80% of the length of the adhesive tape 601. Blade 402 must puncture 602 adhesive tape 601 before being moved across a significant amount of the length of adhesive tape 603, because if a blade does not first puncture 602 adhesive tape 601, blade 402 does not adequately or consistently cut adhesive tape 601.

Figure 7:
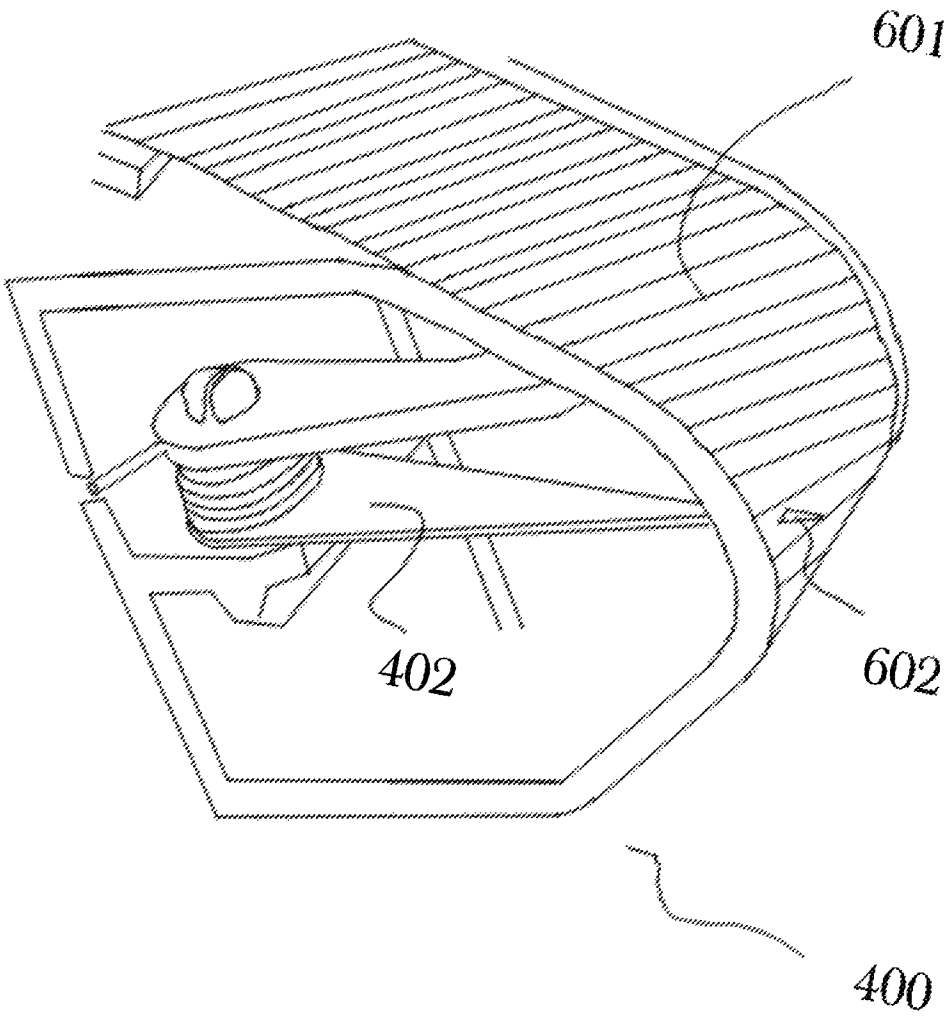
FIG. 7 is an illustration of an aspect of an embodiment, viewed internally, illustrating within device a blade for cutting, and adhesive tape held with tension around device.

FIG. 7 is an illustration of an exemplary assembled adhesive tape dispenser viewed internally, according to an aspect of an embodiment, illustrating within device 400 blade 402 for cutting 603, and adhesive tape 601 held with tension around device 400. Shown in this figure is an exemplary blade 402 which may be made of any particular composition including common steel alloys, piercing 602 adhesive tape 601 which is held with tension around device 400. Tension is crucial in this embodiment, as blade 402 must puncture 602 adhesive tape 601 before attempting to cut it in a moving motion 603, in order to properly function.

Figure 8:
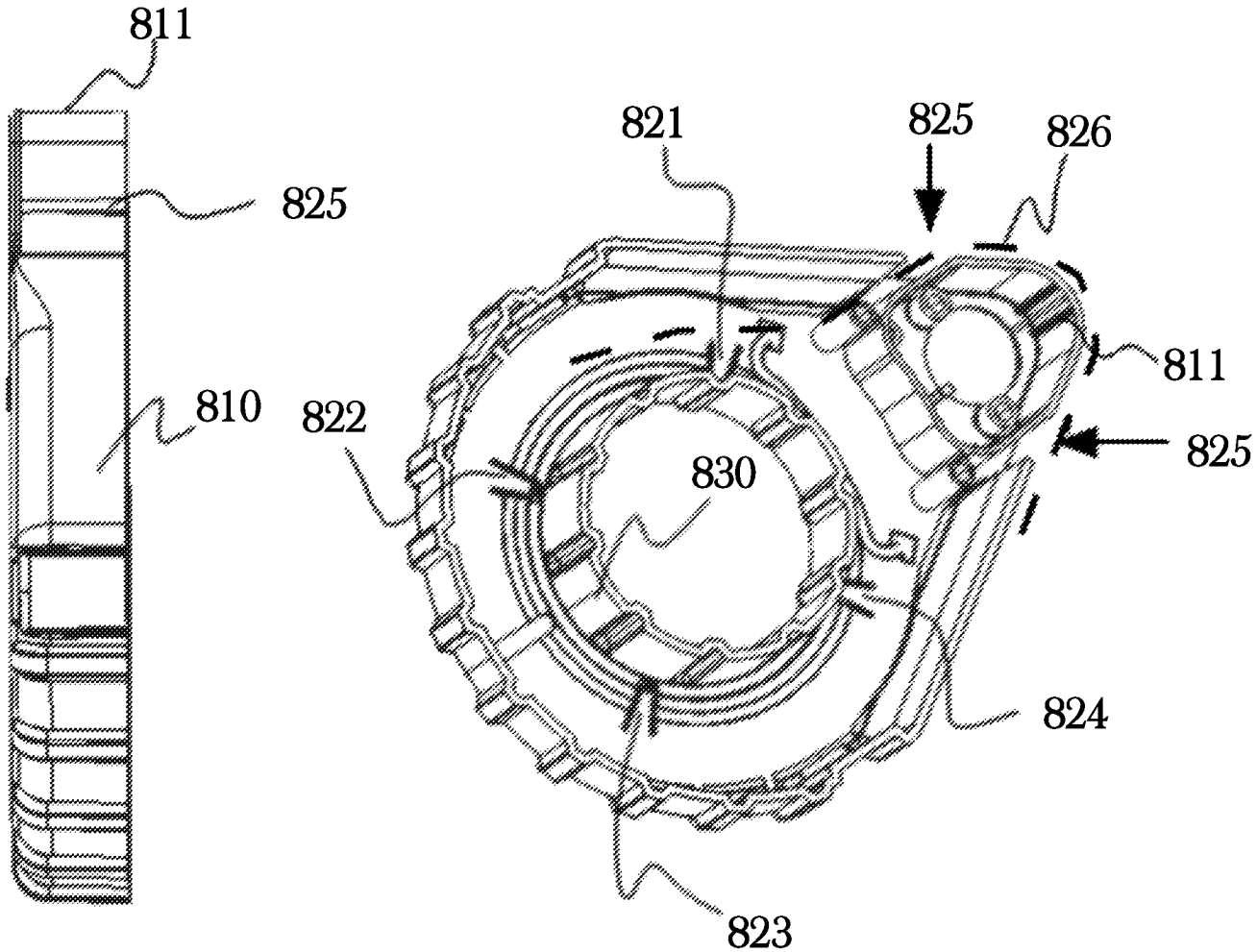
FIG. 8 is a diagram of the interior of a tape dispenser which may hold an attachable tape hub, according to a preferred aspect.

FIG. 8 is a diagram of the interior of a tape dispenser which may hold an attachable tape hub, according to another embodiment. An exterior shell or body 810 holds any interior components and provides a holding surface for a user. During use, the open face of the exterior shell 810 may be placed against a first flat surface of a corner, with the side of the tape roll pressed sideways against that surface, and the tape being applied to the second flat surface of a corner, precisely along the line of the corner. Inside the tape dispenser 100, there are four small leaf-springs 821, 822, 823, 824, which are molded into the body of the tape dispenser, and used to press lightly against the side of a roll of tape that may be placed onto a tape well 830, the springs thus providing a small amount of pressure against the tape holding it flush against the first flat surface of a corner. This tape may be rolled along a path inside die device 826, through at least one tape opening 825, over the device's nose 811. Optionally, the open face of the exterior shell 810 may be covered with a spacing plate (not shown), which holds the tape a fixed distance from the first flat surface of the corner, allowing the tape to be applied along the corner line, but at a fixed distance from the first flat surface of the corner.

Figure 9A:
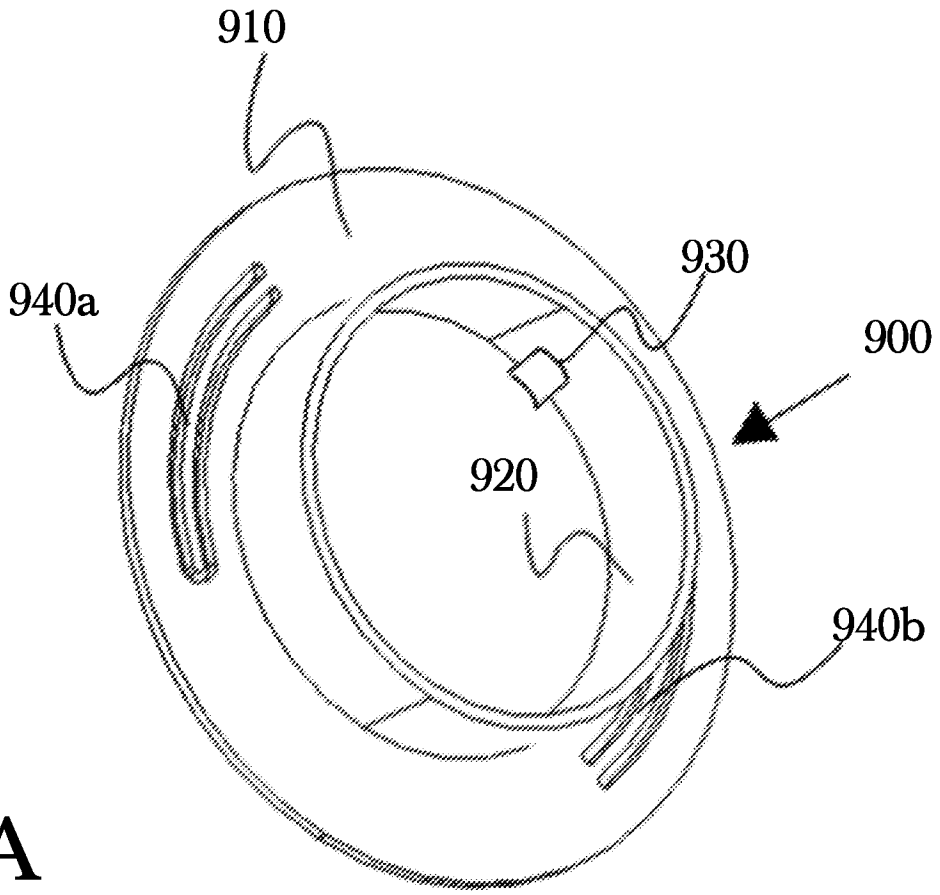
FIG. 9A is a diagram of an attachable tape hub for a tape dispenser device, according to a preferred aspect.

FIG. 9A is a diagram of an attachable tape hub 900 for a tape dispenser device, according to a preferred aspect. As shown in the diagram, an attachable tape hub 900 comprises a disc-shaped surface 910, which leads to a three-dimensional circular well 920 over which may be placed a roll of tape, using the circular well 920 to hold onto said roll of tape. A clip or placeholder 980 exists which may keep a tape hub attached to a dispenser 100. The attachable tape hub 900 is designed to rotate freely while attached to die dispenser body 810, while remaining attached to the dispenser body 810 using the tabs 980. Built into a tape hub 900 through either molding or some other manufacturing process, are two leaf springs 940*a*, 940*b*, which may provide pressure against the interior of the exterior shell or body 810 when placed in a tape dispenser device 100.

Figure 9B:
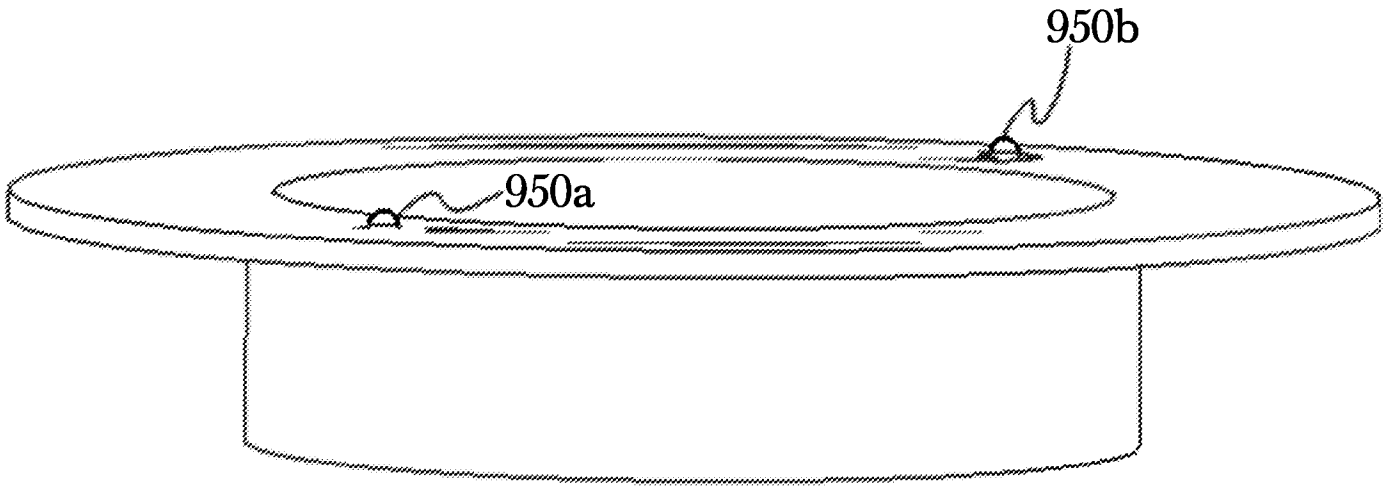
FIG. 9B is a diagram illustrating nodular tips on top of a tape hub which may be used in a dispenser device, according to an embodiment.

FIG. 9B is a diagram illustrating nodular tips on top of a tape hub which may be used in a dispenser device, according to an embodiment. Two nodular tips 950N, 950*b* exist which may apply pressure against the interior of the exterior shell or body 810 of a tape dispenser 100 when a tape hub 900 is inserted into a tape dispenser 100.

Figure 10:
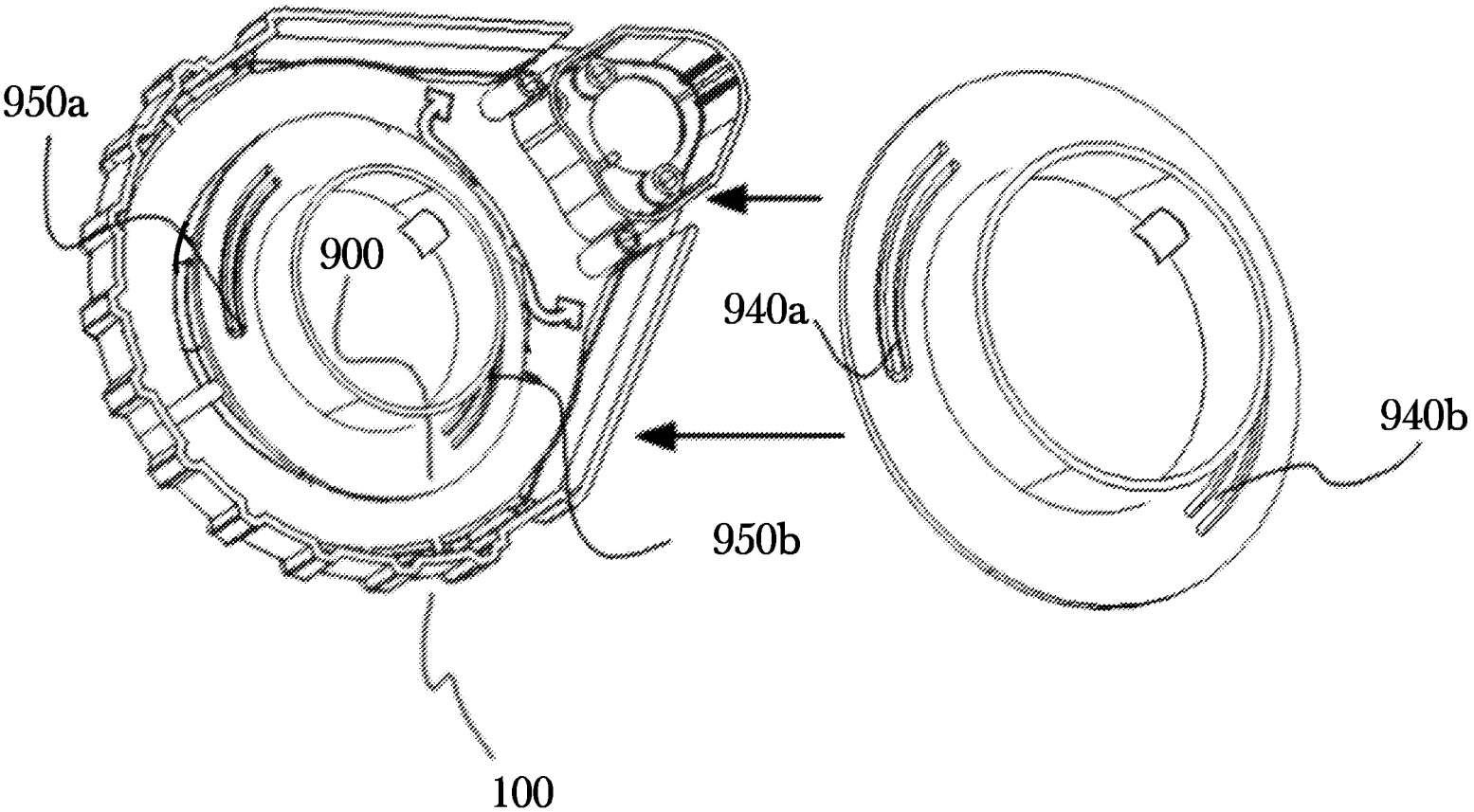
FIG. 10 is a diagram of an attachable tape hub being attached to a dispenser device, according to a preferred embodiment.

FIG. 10 is a diagram of an attachable tape hub being attached to a dispenser device, according to a preferred embodiment. A tape dispenser 100 exists with an exterior body 810, and a tape hub 900 exists to be inserted into a tape dispenser 100, such that a tape hub 900 may be placed over the tape well 880 of the tape dispenser 100, and leaf springs 940*a*, 94*b* may press against the interior of die exterior shell or body 810, pushing the tape hub and any attached roll of tape toward the open face of the exterior shell or body 810, keeping the side of the tape roll (not shown) pressed lightly against a first flat surface of a corner. Two opposing nodular tips 950*a*, 950*b* exists and are on the "bottom" edge of a tape hub 900, which provide points of contact with the body of a tape dispenser 100. When used in this fashion, a roll of tape may be placed onto the tape hub 900 over the circular well of the tape hub 900 inside of a tape dispenser 100, and pressure will be directly applied from leaf springs 940*a*, 940*b* which will in turn provide uniform and indirect pressure onto a roll of tape resting on a tape hub 900, rather than having all four leaf springs 940*a*, 940*b* apply pressure directly onto tape.

Figure 11:
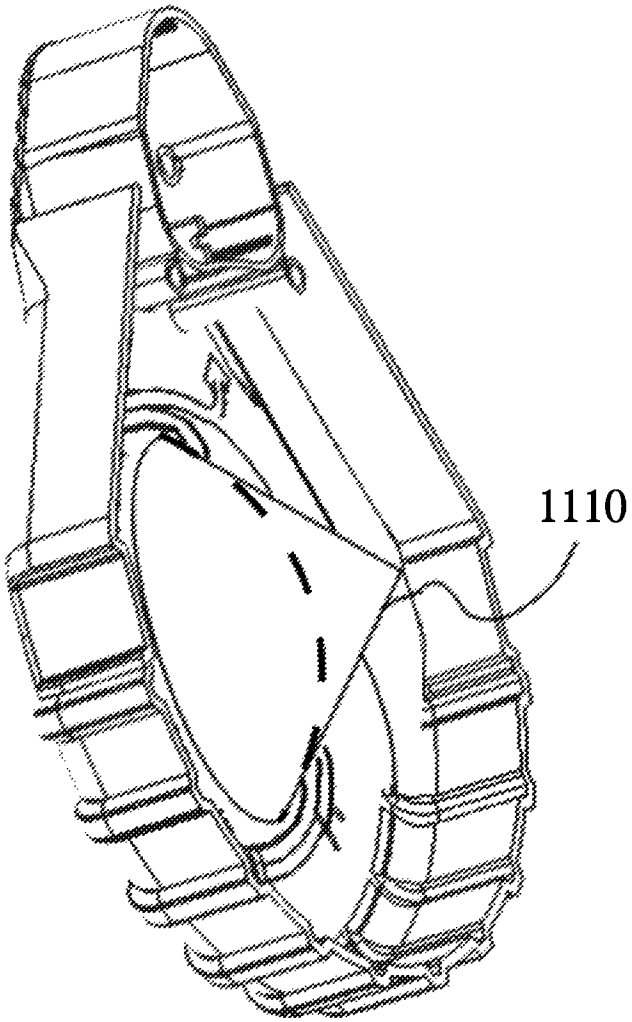
FIG. 11 is a diagram illustrating a tape dispenser device with a tapered tape aligner, according to an aspect of an embodiment.
Figure 11:
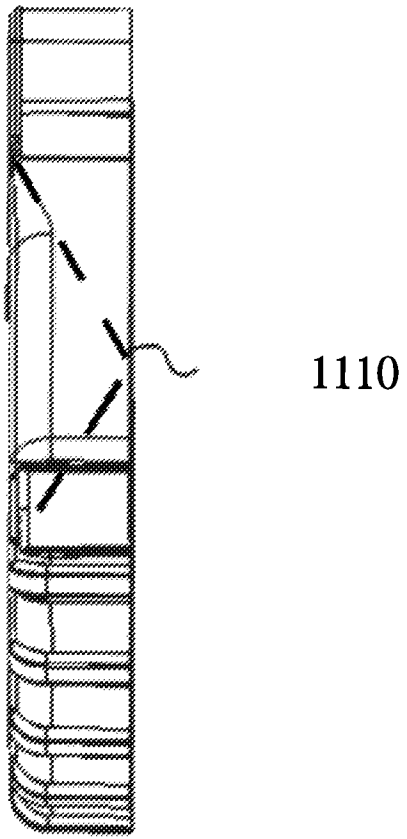

FIG. 11 is a diagram illustrating a tape dispenser device with a tapered tape aligner, according to an aspect of an embodiment. The tape alignment mechanism may comprise a holder with a tapered shape 1110 that uses the force of gravity to keep the tape aligned. In this embodiment, a roll of tape is placed over the conical aligner. During use, the open face of the tape dispenser 100 is placed against a vertical first flat surface of a corner (for example, against a wall), and the force of gravity pulls the tape roll downward against the conical aligner 1110, which tends to push a tape roll (not shown) mounted on the conical aligner 1110 horizontally against the vertical first flat surface of a corner.

In some embodiments, die springs may be fitted with bearings or rollers at die ends instead of nodules. In some embodiments, the tape alignment mechanism may push against the cardboard tube of the tape roll instead of pushing against the side or edge of the tape roll. In some embodiments, the alignment mechanism may guide the side or edge of a partially-dispensed portion of the tape instead of guiding the tape roll. In some embodiments, the alignment mechanism may comprise a force other than springs, such as gravity, to keep die tape aligned. In some embodiments, the tape alignment mechanism may comprised a combination of forces, such as springs and gravity, to keep the tape aligned.

Figure 12:
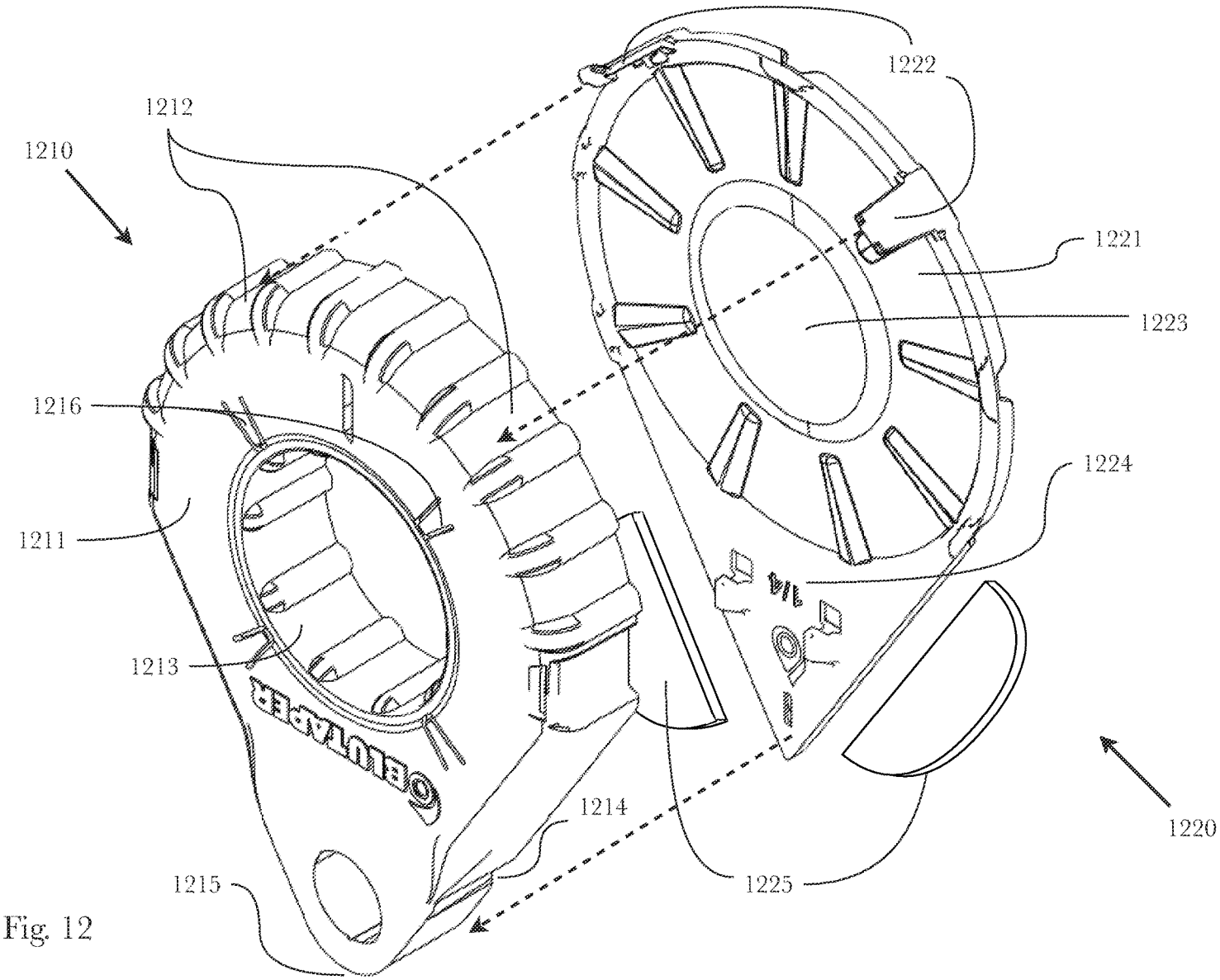
FIG. 12 is a diagram illustrating an orthogonal view of a caulking spacer for a tape dispenser device with optional guides for external corners.

FIG. 12 is a diagram illustrating an orthogonal view of a caulking spacer for a tape dispenser device with optional guides for external corners. In this embodiment, a tape dispenser 1210 is shown, comprising a body or shell 1211 formed from a rigid material or materials comprising a cavity with an open face (not visible from this perspective) and a tape well 1213 within the cavity onto which may be mounted a roll of adhesive tape. The body or shell 1211 further comprises an opening 1214 through which adhesive tape from the roll may be routed from inside the body or shell 1211 to outside the body or shell 1211, the tape being then routed over the nose 1215 of the body or shell 1211 with the adhesive side of the tape facing away from the nose 1215 of the tape dispenser (i.e., with the adhesive side facing outward toward a surface to which the tape may be applied). The tape dispenser 1212 has one or more slots or other attachment points 1212 to which a caulking spacer 1220 may be attached. The body or shell 1211 may have molded into it leaf springs 1216 which serve to press against a first side of a roll of tape placed onto the tape well 1213 such the second side of the roll of tape is pushed toward the open face (not visible in this perspective) or, if die caulking spacer 1220 is attached, against the caulking spacer 1220.

The caulking spacer comprises a face plate 1221 made of a rigid material or materials which may be affixed to the open face (not visible in this perspective) of the body or shell 1211 via tabs, clips, or other fasteners 1222 which attach to the slots or other attachment points 1212. The caulking spacer 1220 may have an opening 1223 corresponding to the size and shape of the tape well 1213, which facilitates gripping of the tape dispenser 1210 with caulking spacer 1220 attached by allowing the user's fingers to be placed through the opening 1223. The thickness of the caulking spacer may vary, with the caulking spacer 1224 of this embodiment showing a thickness of ¼". For dispensing of tape along external (i.e., convex) corners, a caulking spacer 1220 with guides or guide wings 1225 is used. Depending on die configuration, the guides 1225 may be molded onto or otherwise permanently attached to the caulking spacer 1220 or may be removable and re-attachable to the caulking spacer 1220. The guides 1225 may be offset from the caulking spacer 1220 such that the tape is dispensed not precisely at the edge of the external corner, but at a distance away from the edge that depends on the offset. The illustration here shows an embodiment without an offset.

For dispensing of tape along internal (i.e., concave) corners, the nose 1215 of the tape dispenser is pressed against a first surface while the caulking spacer is pressed against a second surface perpendicular to the first surface wherein the first and second surfaces meet at an internal (i.e., concave) corner (such as along the length of a window sill). When the user drags the tape dispenser 1210 along the first surface with the nose 1215 trailing, the tape is dispensed on the first surface at a distance of ¼" from die second surface. Toward die end of dispensing, the user rotates the tape dispenser about the nose 1215 with the nose 1215 still pressed against the first surface, such the nose is now leading. The user pushes the nose into contact with a third surface (i.e., an internal corner now comprising the intersection of three perpendicular surfaces, such as the inside of one of the four corners of a window sill), and operates the cutting blade, which then cuts die tape at the precise length to lay the cut end of die tape exactly along the intersection between the second and third surfaces with the long edge of die tape having been applied along the intersection of the first and second surfaces at a distance of the thickness of the caulking spacer 1220. Different thicknesses of caulking spacer 1220 will cause the tape to be dispensed at different distances from the second, perpendicular surface.

For dispensing of tape along external (i.e., convex) corners, die nose 1215 of the tape dispenser is pressed against a first surface while one of the guides is pressed or held against a second surface (which may or may not be perpendicular to the first surface) wherein the first and second surfaces meet at an external (i.e., convex) corner (such as along the length of a window sill). When die user drags the tape dispenser 1210 along the first surface with the nose 1215 trailing, the tape is dispensed on the first surface at a distance of ¼" from the second surface. Toward the end of dispensing, the user rotates the tape dispenser about the nose 1215 with the nose 1215 still pressed against the first surface, such the nose is now leading. The user pushes the nose into contact with a third surface (i.e., an internal corner now comprising the intersection of three perpendicular surfaces, such as die outside of one of the four corners of a window sill), and operates the cutting blade, which then cuts the tape at the precise length to lay the cut end of the tape exactly along the intersection between the second and third surfaces with the long edge of the tape having been applied along the intersection of the first and second surfaces at a distance of the thickness of the offset of the guides 1225 of the caulking spacer 1220. Different offsets of the guides will cause the tape to be dispensed at different distances from the second surface.

Figure 13:
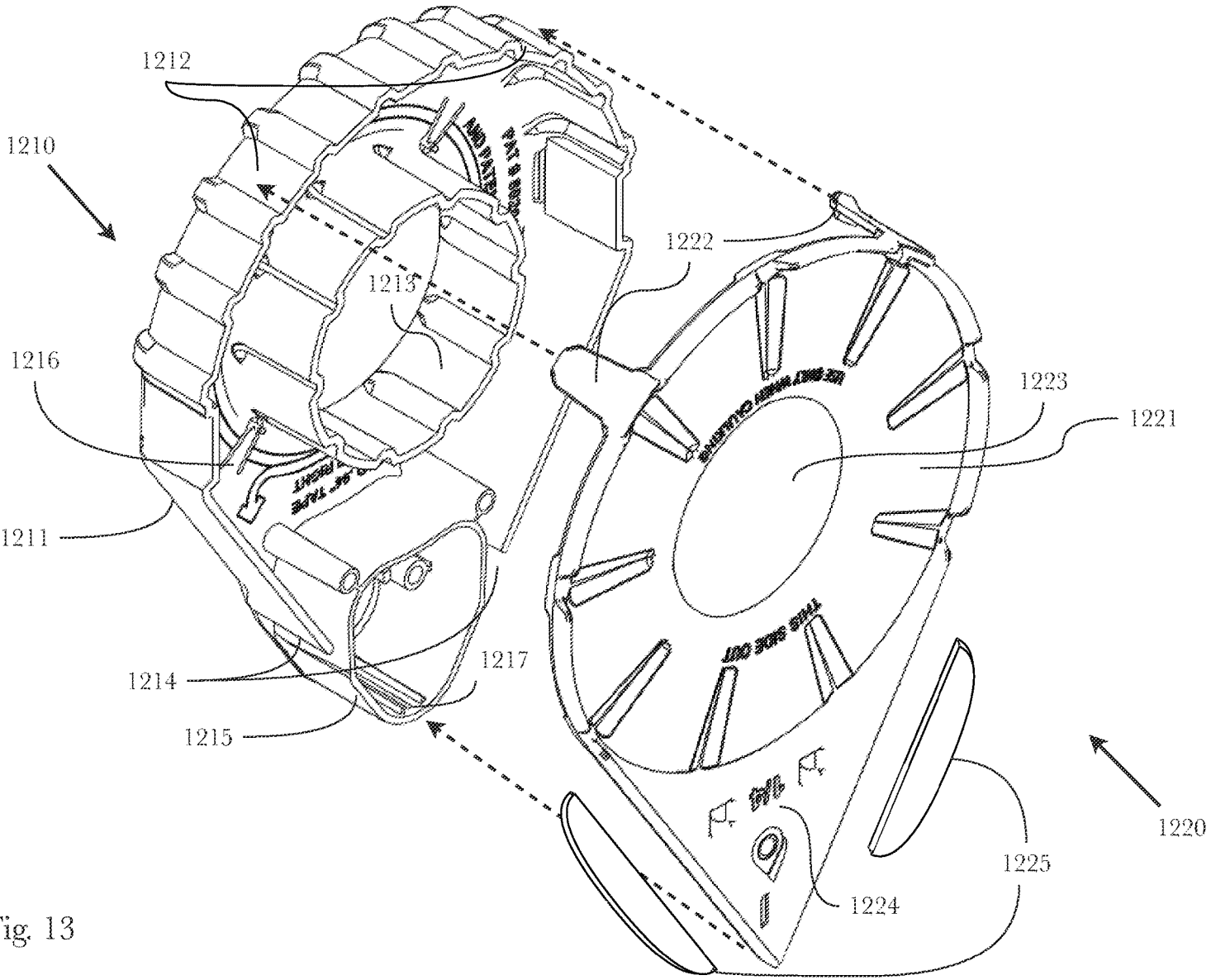
FIG. 13 is a diagram illustrating an alternate orthogonal view of a caulking spacer for a tape dispenser device with optional guides for external corners.

FIG. 13 is a diagram illustrating an alternate orthogonal view of a caulking spacer for a tape dispenser device with optional guides for external corners. This diagram is the same as in FIG. 12, but from the reverse perspective. Here, die open face of the body or shell 1211 can be dearly seen, as well as the shape of the tape well 1213 onto which a roll of adhesive tape may be placed. Further detail is shown regarding the openings 1214 through which tape may be dispensed (one opening on each side such that the device may be used in either direction), the tape being routed from inside the body or shell 1211 to the outside of the body or shell 1211 and then across die nose 1215 with die adhesive side of the tape away from the nose 1215. Also shown here is the opening (i.e., a slot) 1217 through which the cutting blade emerges from inside the body or shell 1211 to pierce and cut the tape routed outside the body or shell 1211 and across the nose 1215.

Figure 14:
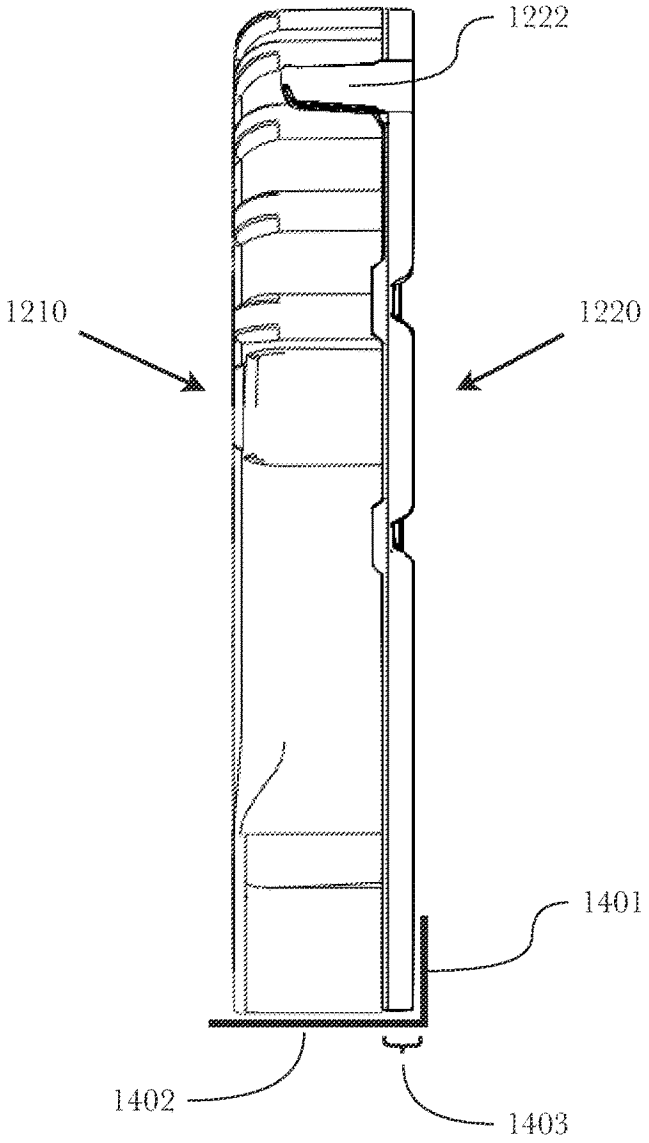
FIG. 14 is a side view of a caulking spacer for a tape dispenser device without guides, for use in internal corners.

FIG. 14 is a side view of a caulking spacer for a tape dispenser device without guides, for use in internal corners. Here, the tape dispenser 1210 is shown with the caulking spacer 1220 attached using tabs, clips, or other fasteners 1222. In this configuration, the caulking spacer 1220 does not have guides 1225, and may be used to apply tape along a first surface 1402 at a distance 1403 determined by the thickness of the caulking spacer 1220 from a second surface 1401.

Figure 15:
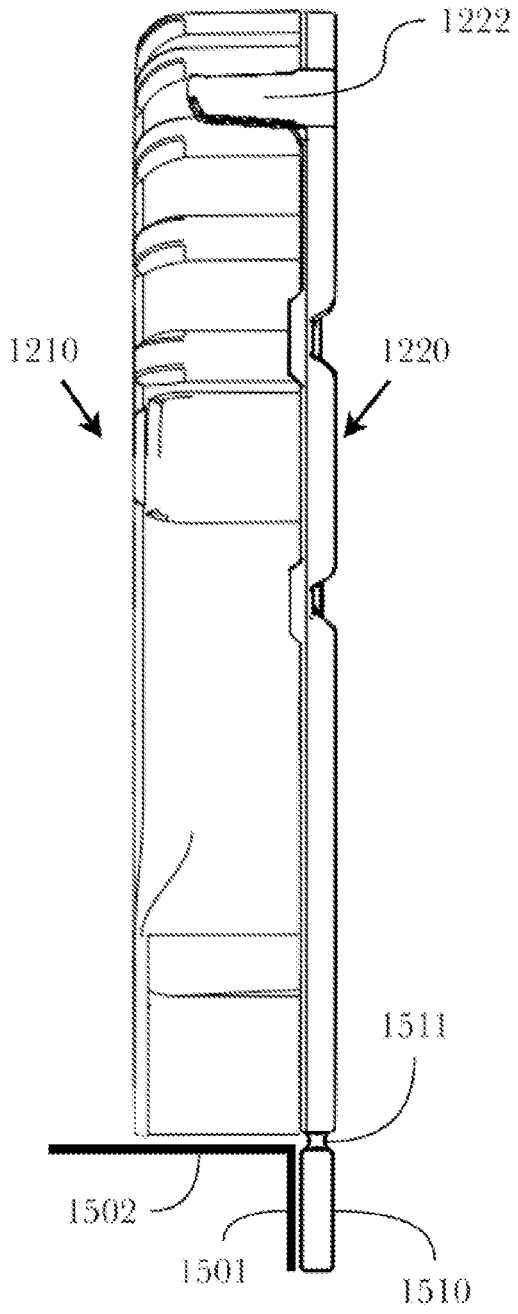
FIG. 15-17 are side views of a caulking spacer for a tape dispenser device with guides, for use in external corners.
Figure 16:
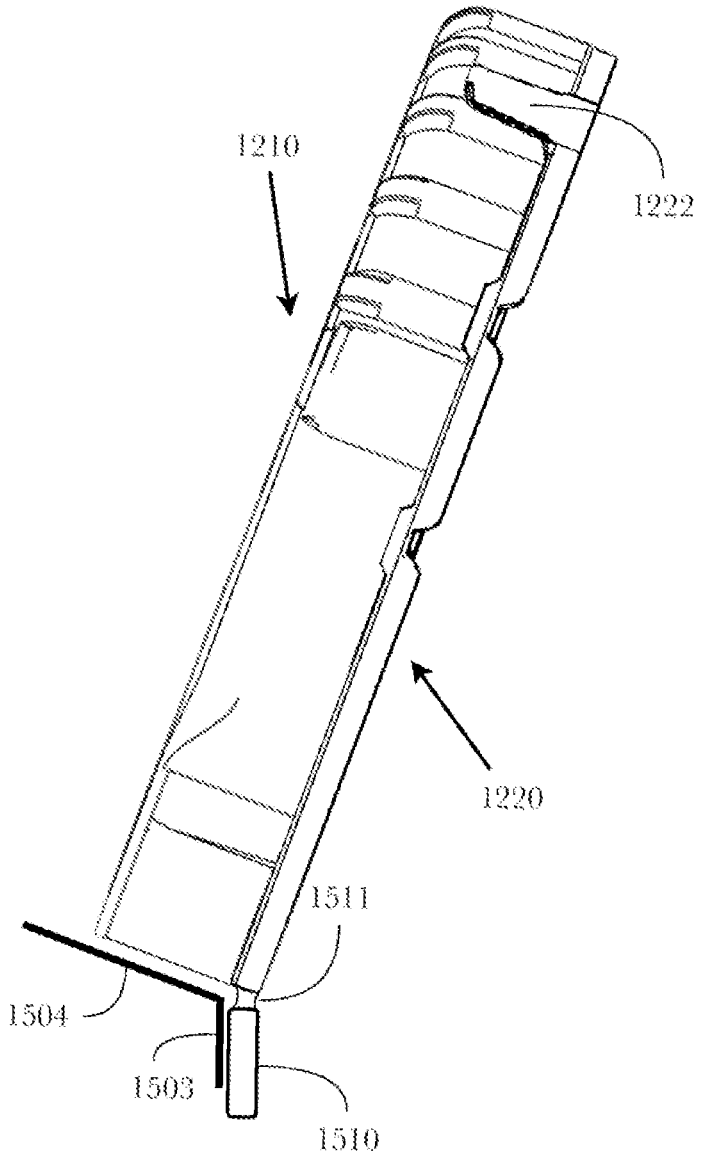
Figure 17:
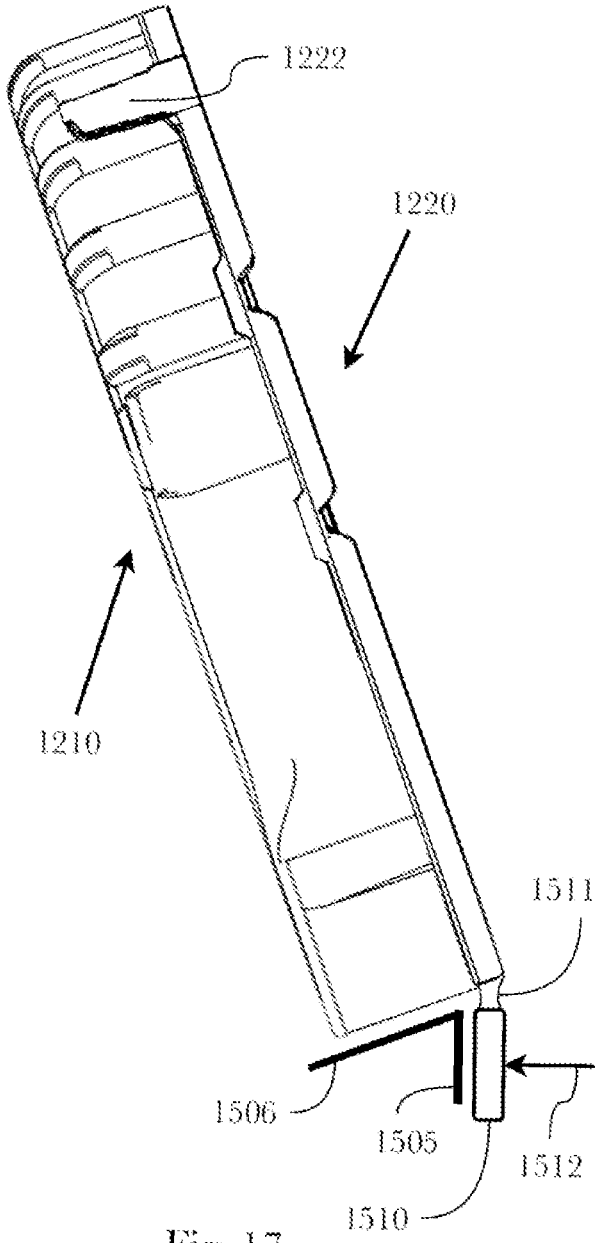

FIGS. 15-17 are side views of a caulking spacer for a tape dispenser device with guides, for use in external corners. In these diagrams, the tape dispenser 1210 is shown with the caulking spacer 1220 attached using tabs, clips, or other fasteners 1222. Here, the caulking spacer 1220 has a guide 1510 permanently attached via a flexible linkage 1511. The caulking spacer 1220, guide 1510, and flexible linkage 1511 in this embodiment are molded from a single piece of plastic with die flexible linkage 1511 being a narrow portion of the molding that allows for flexion in two directions along die length of the narrow portion of the molding. In other embodiments, the guide 1510 and/or flexible linkage 1511 may be of separate pieces and/or materials. For example, the flexible linkage may be made of a rubber or flexible plastic material 1511 and either glued to the caulking spacer 1220 and guide 1510 (as would be the case if the caulking spacer and guide were made from aluminum, for example) or heat welded or solvent bonded to the caulking spacer 1220 and guide 1510 (as would be the case if the caulking spacer and guide were made from hard plastic).

FIG. 15 shows the use of the guide 1510 in dispensing tape along a first surface 1502 of a square external corner with the guide being pressed or held against a second surface of the square external corner 1501. FIG. 16 shows the use of the guide 1510 in dispensing tape along a first surface 1504 of an external corner having an obtuse angle with the guide being pressed or held against a second surface 1503 of the obtuse external corner. In this usage, die resistance to flexion of the flexible linkage 1511 can be used to keep the guide 1510 pressed against the second surface 1503. FIG. 17 shows the use of the guide 1510 in dispensing tape along a first surface 1506 of an external corner having an acute angle with the guide being pressed or held against a second surface 1505 of the acute external corner. In this usage, the resistance to flexion of die flexible linkage 1511 will cause the guide 1510 to stick out away from die second surface 1505, so fingertip pressure 1512 must be used to keep the guide pressed against the second surface 1505. The skilled person will be aware of a range of possible modifications of the various embodiments described above. Accordingly, the present invention is defined by the claims and their equivalents.

What is claimed is:

1. An adhesive tape dispensing device with a caulking spacer, comprising:

a body formed from a rigid material or materials, comprising a cavity with an open face, a tape well within the cavity for holding a roll of adhesive tape, and a plurality of attachment points for the caulking spacer;

a tape alignment mechanism comprising at least one spring attached to the body that presses laterally against a first side of the roll of adhesive tape, the first side being the side of the roll of adhesive tape opposite the open face; and the caulking spacer attached to the open face of the body, the caulking spacer comprising a face plate, a plurality of fasteners for attachment of the plate to the body at the attachment points, and a guide attached to the face plate via a flexible linkage;

wherein the lateral force of the at least one spring causes the roll of adhesive tape to be pushed toward the face plate of the caulking spacer; and wherein, when in use with the guide pressed against a second surface of an external corner, the adhesive tape may be dispensed onto a first surface of the external corner that is not perpendicular to the second surface.

2. The device of claim 1, wherein the at least one spring is a leaf spring.

3. The device of claim 2, wherein the at least one leaf spring is molded or formed from the body of the device.

4. The device of claim 3, wherein the at least one leaf spring further comprises a nodular tip.

5. The device of claim 1, wherein the at least one spring is configured to be adjustable to accommodate different widths of adhesive tape.

6. An adhesive tape dispensing device with a tape alignment mechanism, comprising:

a body formed from a rigid material or materials comprising a cavity with an open face, a tape well within the cavity for holding a roll of adhesive tape, and a plurality of attachment points for a caulking spacer;

a tape alignment mechanism comprising at least one spring attached to the body that presses laterally against the tape hub on a side proximal to a first side of the roll of adhesive tape, the first side being the side of the roll of adhesive tape opposite the face plate of the caulking spacer; and the caulking spacer attached to the open face of the body, the caulking spacer comprising a face plate, a plurality of fasteners for attachment of the plate to the body at the attachment points, and a guide attached to the face plate via a flexible linkage;

wherein the lateral force of the at least one spring causes the tape hub and roll of adhesive tape to be pushed toward the face plate of the caulking spacer; and wherein, when in use with the guide pressed against a second surface of an external corner, the adhesive tape may be dispensed onto a first surface of the external corner that is not perpendicular to the second surface.

7. The device of claim 6, wherein the at least one spring is a leaf spring.

8. The device of claim 7, wherein the at least one leaf spring is molded or formed from the body.

9. The device of claim 8, wherein the at least one leaf spring further comprises a nodular tip.

10. The device of claim 9, wherein the at least one spring is configured to be adjustable to accommodate different widths of adhesive tape.

11. An adhesive tape dispensing device with a tape alignment mechanism, comprising:

a body formed from a rigid material or materials comprising a cavity with an open face, a tape well within the cavity for holding a roll of adhesive tape, and a plurality of attachment points for a caulking spacer, a body formed from a rigid material or materials comprising a cavity with an open face, a tape well within the cavity for holding a tape hub onto which may be mounted a roll of adhesive tape, and a plurality of attachment points for a caulking spacer; and a tape alignment mechanism comprising the tape hub which comprises at least one spring attached to the tape hub that presses laterally against the body on a side proximal to a first side of the roll of adhesive tape, the first side being the side of the roll of adhesive tape opposite the face plate of the caulking spacer, the caulking spacer attached to the open face of the body, the caulking spacer comprising a face plate, a plurality of fasteners for attachment of the plate to the body at the attachment points, and a guide attached to the face plate via a flexible linkage;

wherein the lateral force of the at least one spring causes the tape hub and roll of adhesive tape to be pushed toward the face plate of the caulking spacer; and wherein, when in use with the guide pressed against a second surface of an external corner, the adhesive tape may be dispensed onto a first surface of the external corner that is not perpendicular to the second surface.

12. The device of claim 11, wherein the at least one spring is a leaf spring.

13. The device of claim 12, wherein the at least one leaf spring is molded or formed from the body.

14. The device of claim 13, wherein the at least one leaf spring further comprises a nodular tip.

15. The device of claim 14, wherein the at least one spring is configured to be adjustable to accommodate different widths of adhesive tape.

* * * * *